US005355112A

United States Patent [19]

Nakamura et al.

[11] Patent Number: 5,355,112

[45] Date of Patent: Oct. 11, 1994

[54] FIXED RESISTOR

[75] Inventors: Kazutaka Nakamura; Keisuke Nagata; Yasunobu Yoneda; Hiroji Tani, all of Nagaokakyo, Japan

[73] Assignee: Murata Mfg., Co., Ltd., Japan

[21] Appl. No.: 14,362

[22] Filed: Feb. 5, 1993

[30] Foreign Application Priority Data

Feb. 7, 1992 [JP] Japan ..... 4-56645
Mar. 25, 1992 [JP] Japan ..... 4-100430

[51] Int. Cl.[5] ..... H01C 1/02; H01C 1/012
[52] U.S. Cl. ..... 338/254; 338/306
[58] Field of Search ..... 338/254, 20, 21, 306

[56] References Cited

U.S. PATENT DOCUMENTS 5,140,296 8/1992 Sakaguchi et al. ..... 338/21
5,231,370 7/1993 Arnold, Jr. et al. ..... 338/21

FOREIGN PATENT DOCUMENTS 64-13703 1/1989 Japan .
2-110903 4/1990 Japan .

*Primary Examiner*—Marvin M. Lateef
*Attorney, Agent, or Firm*—Ostrolenk, Faber, Gerb & Soffen

[57] ABSTRACT

A resistor having a ceramic sintered body and at least one resistor film embedded therein so as to be covered by the ceramic sintered body except for portions of the resistor film-chat are connected to external electrodes. The sintered body is mainly composed of ZnO, and contains at least one element of Bi, Pb, B and Si as a subcomponent with respect to the main component.

10 Claims, 1 Drawing Sheet

FIXED RESISTOR

BACKGROUND OF THE INVENTION

1. Field of the Invention

The present invention relates to a resistor which hardly causes dispersion in resistance value, has excellent environment resistance such as moisture proof, and has increased power capacity.

2. Description of the Background Art

In general, a cermet resistor is widely known as a resistive element having high accuracy in resistance value. In order to manufacture such a resistor, resistive paste containing an Ru oxide or an Ru compound is printed on a surface of an alumina substrate, for example, to form a thick resistive paste layer, and this layer is fired at a temperature of 800° to 900° C. to form a resistor film. Then, glass paste is applied to a surface of the resistor film provided on the alumina substrate and fired to form a glass film, thereby improving resistance to the environment, such as moisture proof, of the resistor film.

In such coating of the glass film, however, the resistance value of the resistor film is easily changed to cause dispersion of characteristics. Further, the glass film may contain pinholes, to cause deterioration of the resistance due to penetration of moisture etc. in a high-humidity atmosphere. In addition, the resistor film is inferior in adhesion to the substrate since the alumina substrate, the resistor film and the glass film are all different in thermal expansion coefficient from each other in the aforementioned resistor. In the conventional resistor, therefore, it is impossible to obtain high power capacity so that the upper limit of obtainable power capacity is 100 mW.

SUMMARY OF THE INVENTION

In order to solve the aforementioned problems of the conventional resistor, an object of the present invention is to provide a resistor which hardly causes fluctuation in resistance value and has improved environment resistance such as moisture proof, with a possibility of obtaining high power capacity.

According to an aspect of the present invention, a resistor is provided which comprises a ceramic sintered body containing ZnO as a main component and at least one element selected from a group of Bi, Pb, B and Si as a subcomponent, and at least one resistor film embedded in the ceramic sintered body except portions for electrical connection.

In such a resistor, the resistor film is embedded in the sintered body so that its periphery except portions for electrical connection is covered with the ceramic material forming the sintered body. Therefore, it is possible to omit the glass coating step which has been carried out in general, thereby suppressing fluctuation of the resistance value in manufacturing. Further, deterioration is hardly caused in environment resistance, such as moisture proof, by pinholes which could be formed in the glass coating step. In addition, the aforementioned sintered body contains a subcomponent which is prepared from at least one element selected from the group of Bi, Pb, B and Si to enable sintering at a low temperature, whereby adhesion between the resistor film and the sintered body is improved. Further, the periphery of the resistor film except the portions for electrical connection is enclosed within the sintered body, whereby the radiation property is improved and it is possible to reduce distortion caused by difference in thermal expansion coefficient. Thus, it is possible to obtain high power capacity.

The aforementioned subcomponent which is prepared from at least one element selected from the group of Bi, Pb, B and Si is preferably contained in a range of 0.5 to 20 mole percent in total. If the content of this subcomponent is less than 0.5 mole percent, the sintering process may insufficiently proceed so that the resistor cannot be applied to a resistive element. When the content exceeds 20 mole percent, on the other hand, the ceramic sintered body may easily react with the resistor film, to result in extreme dispersion in resistance value or reduction in power capacity. The subcomponent may contain an additive of Sb, Co, Mn, Ti, Fe or Ni, which is employed for an ordinary ZnO ceramic material, in a range not inhibiting the object of the present invention.

According to another aspect of the present invention, provided is a resistor which comprises a ceramic sintered body containing ZnO as a main component and 0.1 to 10 mole percent, 0.05 to 5 mole percent, 0 to 5 mole percent and 0 to 5 mole percent of Bi, Sb, Co and Mn as subcomponents in terms of $Bi_2O_3$, $Sb_2O_3$, CoO and MnO, respectively, and at least one resistor film embedded in this ceramic sintered body except portions for electrical connection.

Also in the resistor according to this aspect of the present invention, the resistor film is embedded in the sintered body so that its periphery except portions for electrical connection is covered with the ceramic material. Therefore, it is possible to omit the conventional glass coating step, thereby suppressing fluctuation of tile resistance value caused by such glass coating. Further, deterioration is hardly caused in environment resistance, such as moisture proof, by pinholes which may be formed in the glass coating step. In addition, adhesion between the resistor film and the sintered body is improved due to the addition of Bi, Sb, Co and Mn to the main component of ZnO in the aforementioned rates. Further, the periphery of the resistor film except the portions for electrical connection is enclosed within a ceramic sintered body layer, whereby the radiation property can be improved and it is possible to reduce distortion caused by difference in thermal expansion coefficient. Thus, it is possible to implement high power capacity as well as to improve linearity of the resistance value.

In the resistor obtained according to this aspect of the present invention, the contents of the subcomponents are set in the aforementioned rates for the following reason:

While addition of Bi in the aforementioned range leads to improvement in power capacity, reaction with ZnO and insulativity of the sintered body are so insufficient that linearity of the resistance value is deteriorated if Bi is independently added to ZnO. When Sb is added with Bi, on the other hand, sintering progresses even if the content of Bi is small, and it is possible to improve insulativity by suppressing growth of particles in the sintered body. Thus, linearity of the resistance value is improved. However, no sintering progresses if the content of Sb is less than 0.05 mole percent, while the resistance value is increased by reaction with the resistor film to cause dispersion of characteristics if the Sb content exceeds 5 mole percent. On the other hand, addition of Co and Mn leads to no increase of the resistance value since these subcomponents will not react with the resistor film. Therefore, it is not requisite to add Co and Mn in order to prevent fluctuation of the resistance value, while these components are preferably added in order to improve linearity of the resistance value. If the contents of Co and Mn exceed 5 mole percent and 3 mole percent respectively, however, the sintered body may easily react with the resistor film to deteriorate linearity of the resistance value or considerably increase the resistance value.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

A first embodiment of the present invention is now described with reference to the accompanying drawings.

Figure 1:
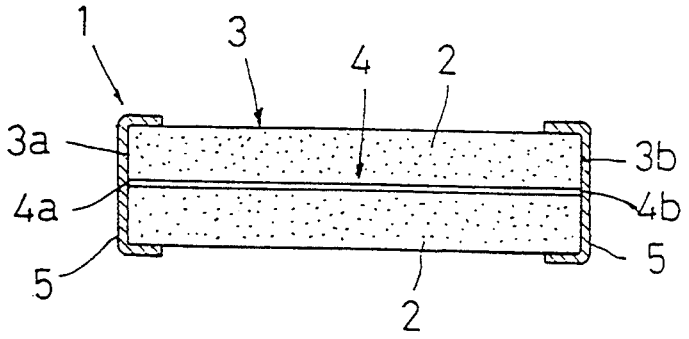
FIG. 1 is a sectional view for illustrating a resistor obtained according to a first embodiment of the present invention.
Figure 2:
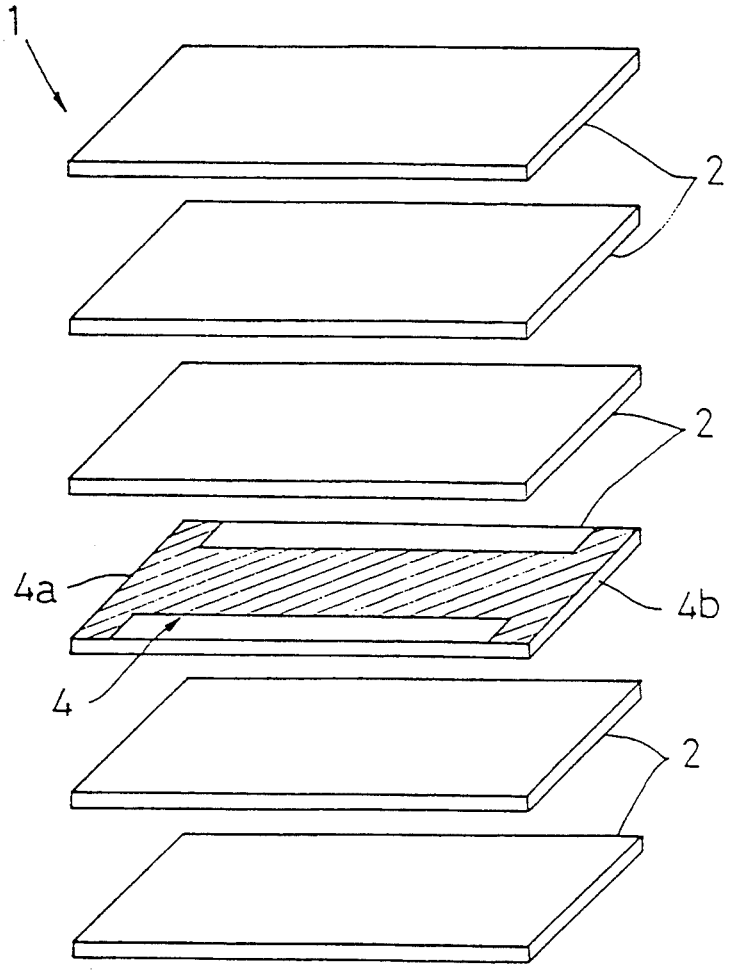
FIG. 2 is an exploded perspective view for illustrating a plurality of ceramic green sheets and a resistor film prepared for manufacturing the resistor according to the embodiment shown in FIG. 1.

FIGS. 1 and 2 are diagrams for illustrating a resistor according to a first embodiment of the present invention.

Referring to FIG. 1, numeral 1 denotes a cermet resistor according to this embodiment. This resistor 1 comprises a ceramic sintered body 3 which is substantially in the form of a rectangular parallelopiped, and a resistor film 4 of an Ru oxide or a compound thereof which is embedded in the ceramic sintered body 3. Left and right end surfaces 4*a* and 4*b* of the resistor film 4 are exposed on left and right side surfaces 3*a* and 3*b* of the sintered body 3 respectively, while other end surfaces are sealed in the sintered body 3. The left and right side surfaces 3*a* and 3*b* of the sintered body 3 are covered with external electrodes 5 of Ag-Pd, which are connected to the respective end surfaces 4*a* and 4*b* of the resistor film 4.

The aforementioned sintered body 3 is formed by stacking a plurality of ceramic green sheets 2 shown in FIG. 2 to obtain a laminate, and cofiring the as-obtained laminate. Each ceramic green sheet 2 is prepared by forming a slurry, which is obtained by mixing a binder and a solvent into a composition containing ZnO as a main component with addition of 0.5 to 20 mole percent in total of at least one element selected from Bi, Pb, B and Si as a subcomponent. The aforementioned resistor film 4 is pattern-formed on one of the ceramic green sheets 2 which is located on a central position along the direction of thickness, so that the ceramic green sheet 2 provided with the resistor film 4 is sandwiched between the remaining ceramic green sheets 2.

The effect of the first embodiment is now described.

In the resistor 1 according to the first embodiment, the resistor film 4 is embedded in the sintered body 3 so that its periphery except the end surfaces 4*a* and 4*b* connected to the external electrodes 5 is covered with the ceramic material, whereby no glass coating is required in contrast to the prior art and it is possible to avoid dispersion of characteristics caused by change of the resistance value. Further, it is also possible to solve the problem of pinholes, whereby environment resistance against moisture etc. can be improved and a deterioration of resistance can be avoided.

The sintered body 3 is prepared from a ceramic material containing ZnO as a main component with addition of 0.5 to 20 mole percent of Bi, Pb, B and/or Si, whereby the sintering temperature can be reduced. Further, thus-obtained resistor film 4 is excellent in adhesion to the sintered body 3 while its periphery except the end surfaces 4*a* and 4*b* is enclosed with the aforementioned ceramic material, whereby the radiation property can be improved and distortion caused by difference in thermal expansion coefficient can be reduced to improve power capacity. While a conventional resistive element has power capacity of about 100 mW at the most, it is possible to attain power capacity at least 10 times greater in the resistor according to this embodiment, with reduction in volume as compared with the conventional element.

In the first embodiment, further, it is possible to omit the conventional steps of applying glass paste to the resistor film and firing the same, whereby the manufacturing cost can be reduced. In addition, stacking of resistor films is enabled so that various resistor films having different resistance values can be freely set in the same pattern and the step.

A method of manufacturing the resistor 1 according to the first embodiment is now described.

First, ZnO employed as a main component is blended with 0.5 to 20 mole percent in total of Bi, Pb, B and/or Si in terms of $Bi_2O_3$, $Pb_2O_3$, $B_2O_3$ and/or $SiO_2$, to form ceramic powder. This powder is crushed and mixed in a ball mill with addition of pure water, to form a slurry.

This slurry is evaporated and dried, and then calcined at 750° C. for 2 hours. The calcined substance is roughly crushed, and then finely crushed in a ball mill with addition of pure water, to form a ceramic raw material. Then a solvent prepared by mixing ethyl alcohol and toluene in a volume ratio of 6:4 is added to the raw material and mixed with the same in a ball mill, to form a slurry.

A green sheet of 70 μm in thickness is formed from this slurry by a doctor blade coater, and this green sheet is dried and thereafter cut into prescribed dimensions to form a number of rectangular ceramic green sheets 2.

Then, a vehicle and glass are added to a composition prepared by blending $RuO_2$, $Ru_2Pb_2O_7$ and $Ru_2Bi_2O_7$ in mole ratios of 6:2:2, to form resistive paste. This resistive paste is printed on an upper surface of one ceramic green sheet 2, to form a resistor film 4. Then, a plurality of ceramic green sheets 2 are stacked on upper and lower surfaces of the ceramic green sheet 2 provided with the resistor film 4 and bonded to each other under a pressure of 2 t/cm$^2$, thereby forming a laminate.

Then the laminate is cut into prescribed dimensions and heated to a temperature of 400° C. to scatter the binder, and thereafter further heated to a temperature of 930° C. and fired for 3 hours to form a sintered body 3. Thus-obtained sintered body 3 is barrel-polished, and thereafter electrode paste containing Ag and Pd in a weight ratio of 7:3 is applied to left and right side surfaces 3*a* and 3*b* of the sintered body 3. The electrode paste layers are fired at 850° C. for 10 minutes to form external electrodes 5, which in turn are electrically connected with left and right side surfaces 4a and 4b of the resistor film 4. Thus, the resistor 1 according to this embodiment is manufactured.

A test which was made for confirming the effect of the resistor 1 according to this embodiment is now described. In this test, samples Nos. 1 to 55 were prepared by the aforementioned manufacturing method with contents of the subcomponents changed in a range of 0.1 to 40 mole percent in total, as shown in Table 1. Then resistance values (Ω), 3CV ($3\sigma$/average×100%, where $\sigma$ represents standard deviation) and power capacity values (mW) were measured. Table 2 shows the results. Referring to Tables 1 and 2, sample numbers marked with an asterisk(*) are out of the ranges defined in claims of the present invention.

TABLE 1

| No. | Zno | $Bi_2O_3$ | $Pb_2O_3$ | $B_2O_3$ | $SiO_2$ |
|---|---|---|---|---|---|
| 1* | 99.9 | 0.1 | | | |
| 2 | 99.5 | 0.5 | | | |
| 3 | 99.0 | 1.0 | | | |
| 4 | 95.0 | 5.0 | | | |
| 5 | 90.0 | 10.0 | | | |
| 6 | 80.0 | 20.0 | | | |
| 7* | 70.0 | 30.0 | | | |
| 8* | 60.0 | 40.0 | | | |
| 9* | 99.9 | | 0.1 | | |
| 10 | 99.5 | | 0.5 | | |
| 11 | 99.0 | | 1.0 | | |
| 12 | 95.0 | | 5.0 | | |
| 13 | 90.0 | | 10.0 | | |
| 14 | 80.0 | | 20.0 | | |
| 15* | 70.0 | | 30.0 | | |
| 16* | 60.0 | | 40.0 | | |
| 17* | 99.9 | | | 0.1 | |
| 18 | 99.5 | | | 0.5 | |
| 19 | 99.0 | | | 1.0 | |
| 20 | 95.0 | | | 5.0 | |
| 21 | 90.0 | | | 10.0 | |
| 22 | 80.0 | | | 20.0 | |
| 23* | 70.0 | | | 30.0 | |
| 24* | 60.0 | | | 40.0 | |
| 25* | 99.9 | | | | 0.1 |
| 26 | 99.5 | | | | 0.5 |
| 27 | 99.0 | | | | 1.0 |
| 28 | 95.0 | | | | 5.0 |
| 29 | 90.0 | | | | 10.0 |
| 30 | 80.0 | | | | 20.0 |
| 31* | 70.0 | | | | 30.0 |
| 32* | 60.0 | | | | 40.0 |
| 33 | 99.5 | 0.3 | 0.2 | | |
| 34 | 99.0 | 0.5 | 0.5 | | |
| 35 | 99.0 | 0.5 | | 0.5 | |
| 36 | 99.0 | 0.5 | | | 0.5 |
| 37 | 99.0 | | 0.5 | 0.5 | |
| 38 | 99.0 | | 0.5 | | 0.5 |
| 39 | 99.0 | | | 0.5 | 2.5 |
| 40 | 95.0 | 2.5 | 2.5 | | |
| 41 | 95.0 | 2.5 | | 2.5 | |
| 42 | 95.0 | 2.5 | | | 2.5 |
| 43 | 95.0 | | 2.5 | 2.5 | |
| 44 | 95.0 | | 2.5 | | 2.5 |
| 45 | 95.0 | | | 2.5 | 2.5 |
| 46 | 97.0 | 1.0 | 1.0 | 1.0 | |
| 47 | 97.0 | 1.0 | 1.0 | | 1.0 |
| 48 | 97.0 | 1.0 | | 1.0 | 1.0 |
| 49 | 97.0 | | 1.0 | 1.0 | 1.0 |
| 50 | 96.0 | 1.0 | 1.0 | 1.0 | 1.0 |
| 51 | 80.0 | 5.0 | 5.0 | 5.0 | 5.0 |
| 52* | 75.0 | 10.0 | 5.0 | 5.0 | 5.0 |
| 53* | 75.0 | 5.0 | 10.0 | 5.0 | 5.0 |
| 54* | 75.0 | 5.0 | 5.0 | 10.0 | 5.0 |
| 55* | 75.0 | 5.0 | 5.0 | 5.0 | 10.0 |

*out of inventive range

TABLE 2

| No. | (1) | Resistance Ω | 3 cv | Power mW | No. | (2) | Resistance Ω | 3 cv | Power mW |
|---|---|---|---|---|---|---|---|---|---|
| 1* | X | | | | 29 | ○ | 5.18K | 17 | 1130 |
| 2 | ○ | 1.49K | 16 | 1110 | 30 | ○ | 15.7K | 24 | 1210 |
| 3 | ○ | 1.57K | 12 | 1250 | 31* | ○ | 96.8K | 42 | 340 |
| 4 | ○ | 1.84K | 15 | 1340 | 32* | ○ | 485.2K | 68 | 125 |
| 5 | ○ | 2.86K | 14 | 1480 | 33 | ○ | 1.23K | 17 | 1110 |
| 6 | ○ | 7.64K | 21 | 1370 | 34 | ○ | 1.36K | 15 | 1560 |
| 7* | ○ | 34.6K | 41 | 341 | 35 | ○ | 1.67K | 15 | 1830 |
| 8* | ○ | 227K | 75 | 117 | 36 | ○ | 1.41K | 18 | 1150 |
| 9* | X | | | | 37 | ○ | 1.74K | 16 | 1130 |
| 10 | ○ | 1.17K | 19 | 1430 | 38 | ○ | 1.85K | 21 | 1240 |
| 11 | ○ | 1.27K | 15 | 1540 | 39 | ○ | 1.54K | 18 | 1380 |
| 12 | ○ | 1.75K | 18 | 1390 | 40 | ○ | 1.85K | 21 | 1480 |
| 13 | ○ | 3.24K | 25 | 1750 | 41 | ○ | 1.95K | 23 | 1580 |
| 14 | ○ | 10.28K | 24 | 1150 | 42 | ○ | 2.12K | 19 | 1230 |
| 15* | ○ | 87.6K | 39 | 243 | 43 | ○ | 2.35K | 15 | 1160 |
| 16* | ○ | 364K | 64 | 96 | 44 | ○ | 2.51K | 17 | 1090 |
| 17* | X | | | | 45 | ○ | 2.34K | 16 | 1280 |
| 18 | ○ | 1.50K | 16 | 1050 | 46 | ○ | 1.55K | 23 | 1540 |
| 19 | ○ | 1.52K | 17 | 1185 | 47 | ○ | 1.92K | 13 | 1370 |
| 20 | ○ | 1.88K | 16 | 1250 | 48 | ○ | 1.56K | 16 | 1060 |
| 21 | ○ | 4.25K | 23 | 1110 | 49 | ○ | 1.47K | 22 | 1280 |
| 22 | ○ | 9.38K | 27 | 1060 | 50 | ○ | 2.00K | 25 | 1250 |
| 23* | ○ | 66.5K | 46 | 410 | 51 | ○ | 13.5K | 27 | 830 |
| 24* | ○ | 193K | 83 | 115 | 52* | ○ | 76.4K | 47 | 251 |
| 25* | X | | | | 53* | ○ | 85.4K | 37 | 185 |
| 26 | ○ | 1.20K | 17 | 1070 | 54* | ○ | 105K | 45 | 360 |
| 27 | ○ | 1.44K | 15 | 1050 | 55* | ○ | 64.5K | 39 | 247 |
| 28 | ○ | 2.01K | 13 | 1080 | | | | | |

(1), (2): Sintering
*out of inventive range
3 cv = 30/average × 100 (%)

As clearly understood from Table 2, the sampled having Nos. 1, 9, 17 and 25 containing less than 0.5 mole percent of the subcomponents in total were inapplicable to resistors, due to no progress in sintering of the ceramic materials. The samples having Nos. 7, 8, 15, 16, 23, 24, 31, 32 and 52 to 55 containing the subcomponents in excess of 20 mole percent in total caused dispersion of resistance values, with low power capacity values of 96 to 410 mW. On the other hand, the samples having Nos. 2 to 6, 10 to 14, 18 to 22, 26 to 30 and 33 to 51 exhibited small dispersion of resistance values with remarkably improved power capacity values of 830 to 1830 mW.

Second Embodiment

A resistor according to a second embodiment off the present invention is now described. In the second embodiment, the resistor is similar in structure to that of the first embodiment, i.e., the resistor 1 shown in FIG. 1. Therefore, the above description of the first embodiment with reference to FIG. 1 is also incorporated by reference to the structure of the second embodiment.

The feature of the second embodiment resides in that the sintered body 3 shown in FIG. 1 is made of a ceramic material containing ZnO as a main component with addition of Bi, Sb, Co and Mn serving as subcomponents in the following specific rates: The contents of Bi, Sb, Co and Mn are in ranges of 0.1 to 10 mole percent, 0.05 to 5 mole percent, 0 to 5 mole percent and 0 to 3 mole percent in terms of oxides of $Bi_2O_3$, $Sb_2O_3$, CoO and MnO, respectively.

The resistor according to the second embodiment is also obtained by stacking a plurality of ceramic green sheets 2 shown in FIG. 2 with interposition of a resistor film 4 and co-firing the thus-obtained laminate, similarly to the first embodiment. Therefore, the ceramic green sheets 2 are prepared from the ceramic material having the aforementioned composition containing Bi, Sb, Co and Mn in the aforementioned rates.

The effect of the second embodiment is now described.

Also in the resistor according to the second embodiment, the resistor film is embedded in the sintered body so that its periphery except end surfaces of external electrodes is covered with the ceramic material, whereby no glass coating is required in contrast to the prior art and it is possible to avoid dispersion of characteristics caused by change of the resistance value. Further, it is also possible to solve the problem of pinholes, whereby environment resistance against moisture etc. can be improved to prevent deterioration of resistance.

Since the sintered body is made of the ceramic material which contains ZnO as a main component with addition of the oxides of Bi, Sb, Co and Mn serving as subcomponents, it is possible to reduce the sintering temperature. Thus-obtained resistor film has excellent adhesion to the sintered body and its periphery except end surfaces of external electrodes is enclosed with the aforementioned ceramic material, whereby the radiation property can be improved and distortion caused by difference in thermal expansion coefficient can be reduced to improve power capacity. While a conventional resistive element has power capacity of about 100 mW at the most, the resistor according to the second embodiment can attain power capacity of at least 10 times greater with reduction in volume as compared with the conventional element. Further, it is possible to improve linearity of the resistance value due to the addition of the aforementioned subcomponents.

In the second embodiment, further, it is possible to omit the conventional steps of applying glass paste to the resistor film and firing the same, whereby the manufacturing cost can be reduced. In addition, stacking of resistor films is enabled so that various resistor films having different resistance values can be freely set in the same pattern and the step.

A method of manufacturing the resistor according to the second embodiment is now described.

First, ZnO serving as a main component is blended with 0.1 to 10 mole percent, 0.05 to 5 mole percent, 0 to 5 mole percent and 0 to 3 mole percent of Bi, Sb, Co and Mn in terms of $Bi_2O_3$, $Sb_2O_3$, CoO and MnO, respectively, to form ceramic powder. This powder is crushed and mixed in a ball mill with addition of pure water, to form a slurry.

Then the slurry is evaporated and dried, and calcined at 750° C. for 2 hours. The calcined substance is roughly crushed, and then finely crushed in a ball mill with addition of pure water, to form a ceramic raw material. Then a solvent obtained by mixing ethyl alcohol and toluene in a capacity ratio of 6:4 is added to this raw material and mixed in a ball mill, to form a slurry.

A green sheet of 70 μm in thickness is formed from this slurry by a doctor blade coater, and this green sheet is dried and thereafter cut into prescribed dimensions to form a number of rectangular ceramic green sheets 2.

The resistor according to the second embodiment is manufactured in a manner similar to the first embodiment, except that the aforementioned ceramic green sheets are employed.

A test which was carried out for confirming the effect of the resistor according to the second embodiment is now described. In this test, samples having Nos. 61 to 112 were prepared by the aforementioned manufacturing method with contents of $Bi_2O_3$ and those of $Sb_2O_3$, CoO and MnO changed in ranges of 0.1 to 30 mole percent and 0.03 to 10.0 mole percent, respectively, as shown in Table 3. Then resistance values (Ω), 3CV ($3\sigma$/average×100%), power capacity values (mW) and linearity levels ($\alpha$) of the resistance values were measured. The linearity levels were found by $\alpha=1/\log(R_{1MA}/R_{0.1MA})$. Table 4 shows the results. Referring to Tables 3 and 4, sample numbers marked with asterisk (*) are out of the ranges defined in the claims of the present invention.

TABLE 3

| No. | ZnO | $Bi_2O_3$ | $Sb_2O_3$ | CoO | MoO |
|---|---|---|---|---|---|
| 61* | 99.9 | 0.1 | | | |
| 62* | 99.5 | 0.5 | | | |
| 63* | 99.0 | 1.0 | | | |
| 64* | 95.0 | 5.0 | | | |
| 65* | 90.0 | 10.0 | | | |
| 66* | 80.0 | 20.0 | | | |
| 67* | 70.0 | 30.0 | | | |
| 68* | 98.97 | 1.0 | 0.03 | | |
| 69 | 98.95 | 1.0 | 0.05 | | |
| 70 | 98.9 | 1.0 | 0.10 | | |
| 71 | 98.7 | 1.0 | 0.30 | | |
| 72 | 98.5 | 1.0 | 0.50 | | |
| 73 | 98.0 | 1.0 | 1.00 | | |
| 74 | 96.0 | 1.0 | 3.00 | | |
| 75 | 94.0 | 1.0 | 5.00 | | |
| 76* | 89.0 | 1.0 | 10.00 | | |
| 77 | 98.47 | 1.0 | 0.50 | 0.03 | |
| 78 | 98.45 | 1.0 | 0.50 | 0.05 | |
| 79 | 98.4 | 1.0 | 0.50 | 0.10 | |
| 80 | 98.2 | 1.0 | 0.50 | 0.30 | |
| 81 | 98.0 | 1.0 | 0.50 | 0.50 | |
| 82 | 97.5 | 1.0 | 0.50 | 1.00 | |
| 83 | 95.5 | 1.0 | 0.50 | 3.00 | |
| 84 | 93.5 | 1.0 | 0.50 | 5.00 | |
| 85* | 88.5 | 1.0 | 0.50 | 10.00 | |
| 86 | 98.47 | 1.0 | 0.50 | | 0.03 |
| 87 | 98.45 | 1.0 | 0.50 | | 0.05 |
| 88 | 98.4 | 1.0 | 0.50 | | 0.10 |
| 89 | 98.2 | 1.0 | 0.50 | | 0.30 |
| 90 | 98.0 | 1.0 | 0.50 | | 0.50 |
| 91 | 97.5 | 1.0 | 0.50 | | 1.00 |
| 92 | 95.5 | 1.0 | 0.50 | | 3.00 |
| 93* | 93.5 | 1.0 | 0.50 | | 5.00 |
| 94* | 88.5 | 1.0 | 0.50 | | 10.00 |
| 95* | 99.87 | 0.1 | 0.03 | | |
| 96 | 99.85 | 0.1 | 0.05 | | |
| 97 | 99.8 | 0.1 | 0.10 | | |
| 98 | 98.9 | 0.1 | 1.00 | | |
| 99 | 96.9 | 0.1 | 3.00 | | |
| 100 | 94.9 | 0.1 | 5.00 | | |
| 101* | 99.67 | 0.3 | 0.03 | | |
| 102 | 99.65 | 0.3 | 0.05 | | |
| 103 | 99.6 | 0.3 | 0.10 | | |
| 104 | 98.7 | 0.3 | 1.00 | | |
| 105 | 96.7 | 0.3 | 3.00 | | |
| 106 | 94.7 | 0.3 | 5.00 | | |
| 107* | 99.47 | 0.5 | 0.03 | | |
| 108 | 99.45 | 0.5 | 0.05 | | |
| 109 | 99.4 | 0.5 | 0.10 | | |
| 110 | 98.5 | 0.5 | 1.00 | | |
| 111 | 96.5 | 0.5 | 3.00 | | |
| 112 | 94.5 | 0.5 | 5.00 | | |

*out of inventive range

TABLE 4

| No. | (1) | Resistance Ω | 3 cv | Power mW | a | No. | (2) | Resistance Ω | 3 cv | Power mW | a |
|---|---|---|---|---|---|---|---|---|---|---|---|
| 61* | X | | | | | 87 | ○ | 1.42K | 17 | 1530 | 1.02 |
| 62* | X | | | | | 88 | ○ | 1.39K | 15 | 1430 | 1.00 |
| 63* | ○ | 1.57K | 12 | 1250 | 1.83 | 89 | ○ | 1.47K | 11 | 1240 | 1.00 |
| 64* | ○ | 1.84K | 15 | 1340 | 1.60 | 90 | ○ | 1.82K | 22 | 1350 | 1.03 |
| 65* | ○ | 2.86K | 14 | 1480 | 1.69 | 91 | ○ | 2.62K | 26 | 1450 | 1.12 |
| 66* | ○ | 7.64K | 21 | 1370 | 1.54 | 92 | ○ | 11.3K | 29 | 1320 | 1.21 |
| 67* | ○ | 34.6K | 41 | 341 | 1.51 | 93* | ○ | 182K | 51 | 1200 | 1.52 |
| 68* | X | | | | | 94* | X | | | | |
| 69 | ○ | 0.54K | 16 | 1650 | 1.11 | 95* | X | | | | |
| 70 | ○ | 0.63K | 16 | 1420 | 1.10 | 96 | ○ | 0.62K | 27 | 760 | 1.13 |
| 71 | ○ | 0.84K | 16 | 1530 | 1.11 | 97 | ○ | 0.65K | 24 | 1040 | 1.14 |
| 72 | ○ | 1.26K | 19 | 1640 | 1.12 | 98 | ○ | 0.95K | 16 | 1350 | 1.11 |
| 73 | ○ | 5.74K | 21 | 1430 | 1.09 | 99 | ○ | 1.37K | 16 | 1480 | 1.12 |
| 74 | ○ | 10.42K | 27 | 1210 | 1.05 | 100 | ○ | 5.82K | 20 | 1440 | 1.10 |
| 75 | ○ | 140K | 32 | 852 | 1.10 | 101* | X | | | | |
| 76* | ○ | 3.4M | 82 | 73 | 1.40 | 102 | ○ | 0.74K | 20 | 880 | 1.21 |
| 77 | ○ | 1.27K | 10 | 1840 | 1.02 | 103 | ○ | 0.82K | 21 | 1180 | 1.15 |
| 78 | ○ | 1.32K | 13 | 1750 | 1.01 | 104 | ○ | 1.25K | 17 | 1330 | 1.10 |
| 79 | ○ | 1.28K | 15 | 1650 | 1.01 | 105 | ○ | 3.49K | 15 | 1560 | 1.12 |
| 80 | ○ | 1.43K | 18 | 1720 | 1.00 | 106 | ○ | 7.90K | 17 | 1490 | 1.10 |
| 81 | ○ | 1.54K | 23 | 1860 | 1.02 | 107* | X | | | | |
| 82 | ○ | 1.62K | 27 | 1570 | 1.06 | 108 | ○ | 0.41K | 11 | 1040 | 1.12 |
| 83 | ○ | 1.74K | 26 | 1720 | 1.25 | 109 | ○ | 0.50K | 15 | 1370 | 1.12 |
| 84 | ○ | 1.90K | 29 | 1640 | 1.35 | 110 | ○ | 0.76K | 14 | 1460 | 1.11 |
| 85* | ○ | 2.20K | 33 | 1340 | 1.65 | 111 | ○ | 0.99K | 20 | 1380 | 1.09 |
| 86 | ○ | 1.31K | 12 | 1420 | 1.06 | 112 | ○ | 4.38K | 18 | 1450 | 1.10 |

(1), (2): Sintering
*out of inventive range
3 cv = 30/average × 100 (%)

As clearly understood from Table 4, in some of the samples having Nos. 61 to 67, which were prepared with addition of only $Bi_2O_3$, linearity levels of the resistance values were deteriorated to exceed 1.51., However, with these samples the linearity of the resistance valves can be improved by adding at least one of other additives. Further, the samples having Nos. 68, 95, 101 and 107 containing $Sb_2O_3$ in contents of less than 0.03 mole percent were inapplicable to resistors due to insufficient progress in sintering of the ceramic materials. In the sample No. 76 containing $Sb_2O_3$ in excess of 10 mole percent, on the other hand, the resistance value was increased to 3.4 MΩ, with dispersion in resistance and reduction of power capacity. In the samples having Nos. 85, 93 and 94 containing CoO and MnO in excess of 10 mole percent and 5 mole percent, respectively, further, the resistance values were increased and linearity levels were deteriorated.

On the other hand, the samples having Nos. 66 to 75, 77 to 84, 86 to 92, 96 to 100, 102 to 106 and 108 to 112, containing the subcomponents in the ranges according to the present invention, exhibited low resistance values of 0.41 to 11.3 KΩ with small dispersion of 10 to 32%. It is understood that the power capacity levels were remarkably improved to 760 to 1860 mW and linearity levels of the resistance values were also improved to 1.00 to 1.35 in these samples.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A resistor comprising a ceramic sintered body, said ceramic sintered body comprising ZnO as a main component and at least one element selected from the group consisting of Bi, Pb, B and Si as a subcomponent; and at least one resistor film, said resistor film being embedded in said ceramic sintered body so as to be covered by said ceramic sintered body in all portions except for portions of said resistor film that are exposed for electrical connection.

2. A resistor in accordance with claim 1, wherein said element selected from said group consisting of Bi, Pb, B and Si is in a range of 0.5 to 20 mole percent in total.

3. A resistor in accordance with claim 1, wherein at least one element selected from the group consisting of Sb, Co, Mn, Ti, Fe and Ni is added to said subcomponent.

4. A resistor in accordance with claim 1, wherein said ceramic sintered body is obtained by stacking a plurality of ceramic green sheets with said resistor film being interposed therebetween so as to form a laminate, and firing the laminate.

5. A resistor in accordance with claim 1, wherein said resistor film is made of a material comprised of an Ru oxide or an Ru compound.

6. A resistor in accordance with claim 1, wherein both said resistor film and said sintered body each have two ends, the respective ends of said resistor film are formed so as to reach respective end surfaces of said sintered body to form said portions that are exposed for electrical connection, and a pair of external electrodes, each one of said pair of external electrodes being formed on one of said respective end surfaces of said sintered body, respectively, and being connected with the respective one of said ends of said resistor film.

7. A resistor comprising:

a ceramic sintered body, said ceramic sintered body comprising ZnO as a main component and subcomponents including Bi, Sb, Co and Mn, said subcomponents being provided in ranges of 0.1 to 10 mole percent, 0.05 to 5 mole percent, 0 to 5 mole percent and 0 to 3 mole percent in terms of $Bi_2O_3$, $Sb_2O_3$, CoO and MnO, respectively; and at least one resistor film, said resistor film being embedded in said ceramic sintered body so as to be covered by said ceramic sintered body in all portions except for portions of said resistor film that are exposed for electrical connection.

8. A resistor in accordance with claim 7, wherein said ceramic sintered body is obtained by stacking a plurality of ceramic green sheets with said resistor film being interposed therebetween so as to form a laminate, and firing the laminate.

9. A resistor in accordance with claim 7, wherein said resistor film is made of a material comprised of an Ru oxide or an Ru compound.

10. A resistor in accordance with claim 7, wherein both said resistor film and said sintered body each have two ends, the respective ends of said resistor film are formed so as to reach respective end surfaces of said sintered body to form said portions that are exposed for electrical connection, and a pair of external electrodes, each one of said pair of external electrodes being formed on one of said respective end surfaces of said sintered body, respectively, and being connected with the respective one of said ends of said resistor film.

* * * * *